United States Patent [19]

Iannicelli

[11] 3,999,958

[45] Dec. 28, 1976

[54] COAL BENEFICIATION

[76] Inventor: Joseph Iannicelli, 157 Darien Highway, Brunswick, Ga. 31520

[22] Filed: Aug. 14, 1974

[21] Appl. No.: 497,279

Related U.S. Application Data

[63] Continuation-in-part of Ser. No. 448,350, March 5, 1974, abandoned.

[52] U.S. Cl. ..... 44/1 R

[51] Int. Cl.[2] ..... C10L 9/10

[58] Field of Search ..... 44/1 R; 75/6–9, 75/42; 208/8; 201/17

[56] References Cited

UNITED STATES PATENTS

| | | | |
|---|---|---|---|
| 1,714,280 | 5/1929 | Sieurin | 75/6 X |
| 2,495,225 | 1/1950 | Buehl et al. | 75/6 X |
| 3,725,241 | 4/1973 | Chervenak | 208/8 X |

FOREIGN PATENTS OR APPLICATIONS

| | | | |
|---|---|---|---|
| 166,471 | 1/1956 | Australia | 201/17 |

*Primary Examiner*—Carl F. Dees
*Attorney, Agent, or Firm*—Ely Silverman

[57] ABSTRACT

Particular readily separable particulate sulphur-reactive scavenging materials are heated with sulphur containing particulate coal to extract sulphur from that coal. Reacted portions of the particulate scavenging material are then separated from the particles of coal, using a separating force effective on the scavenging material and which serves to also separate the reacted portions of the scavenging materials.

5 Claims, 5 Drawing Figures

FIG. 5
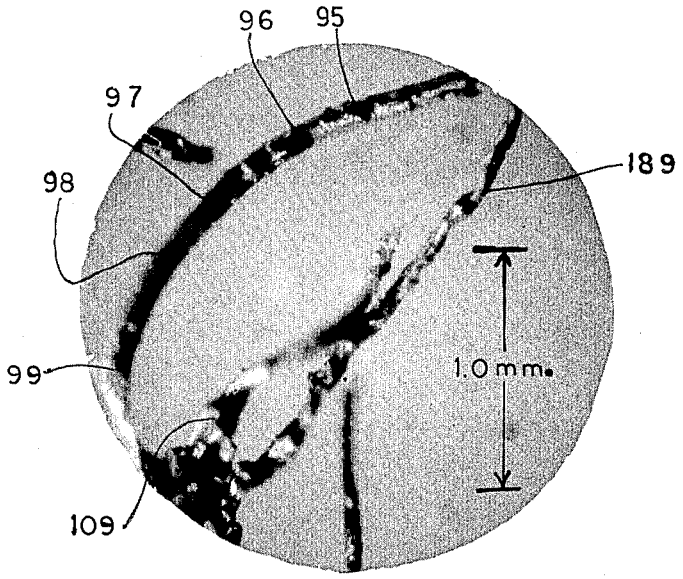
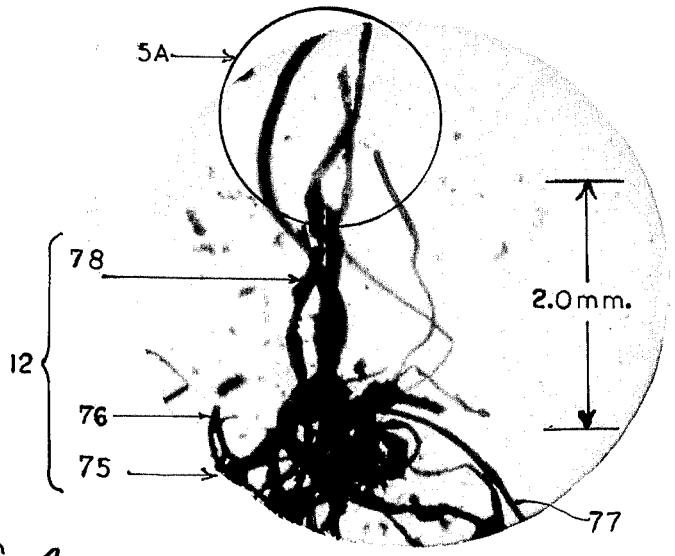
FIG. 4

COAL BENEFICIATION

RELATION TO OTHER APPLICATIONS

This application is a continuation-in-part of my copending application Ser. No. 448,350, filed Mar. 5, 1974, entitled COAL BENEFICIATION now abandoned.

BACKGROUND OF THE INVENTION

1. The Field of the Invention

The fields of art to which this invention pertains are coal beneficiation and sulfur removal from hydrocarbons.

2. Description of the Prior Art

The prior art has separated magnetic materials and metallic particles from coal, but has not effected the removal of sulphur bound to organic material in the coal, although such sulphur is a significant portion of the sulphur content of coal. Sulphur in organic compounds has long been deemed not removable mechanically (*Coal Preparation*, American Institute of Mining and Metallurgical Engineers, page 70) and the removal of contaminants by conversion to magnetic form, as in U.S. Pat. No. 3,463,310 has been deemed not practical as discussed in U.S. Pat. No. 3,725,241.

SUMMARY OF THE INVENTION

Ferromagnetic particles particularly chemically reactive at their surface and susceptible to corrosion, as steel wool and shavings, while retaining magnetic characteristics of the interior portions of their mass are reacted at elevated temperatures with sulphur bearing coal and extract sulphur therefrom. The unreacted interior portions of the individual magnetic particles provide for removal from the coal particles, by magnetic separators, of the composite of sulphur bearing surface and magnetically susceptible interior mass and of weakly magnetic particles by the unreacted ferromagnetic particles. The large surface to mass ratio of steel wool fibrous particles is used to separate such elements from the weakly magnetic equiaxed magnetic pyrrhotite particles created by reaction of the steel wool surface and pyrite in the coal to provide for economic recovery and recycling of such particles.

According to another embodiment of this invention, the flotation characteristics of scavenging particles are utilized to separate scavenging particles after removal of sulfur from the coal by such scavenging particles.

BRIEF DESCRIPTION OF THE DRAWINGS

FIG. 4 is an enlarged photographic view of the scavenging particles after reaction in chamber 15 and separation from the coal treated thereby.

FIG. 5 is a further enlarged view of the scavenging particles in a Zone as 5A of FIG. 4.

DESCRIPTION OF THE PREFERRED EMBODIMENT

Figure 1:
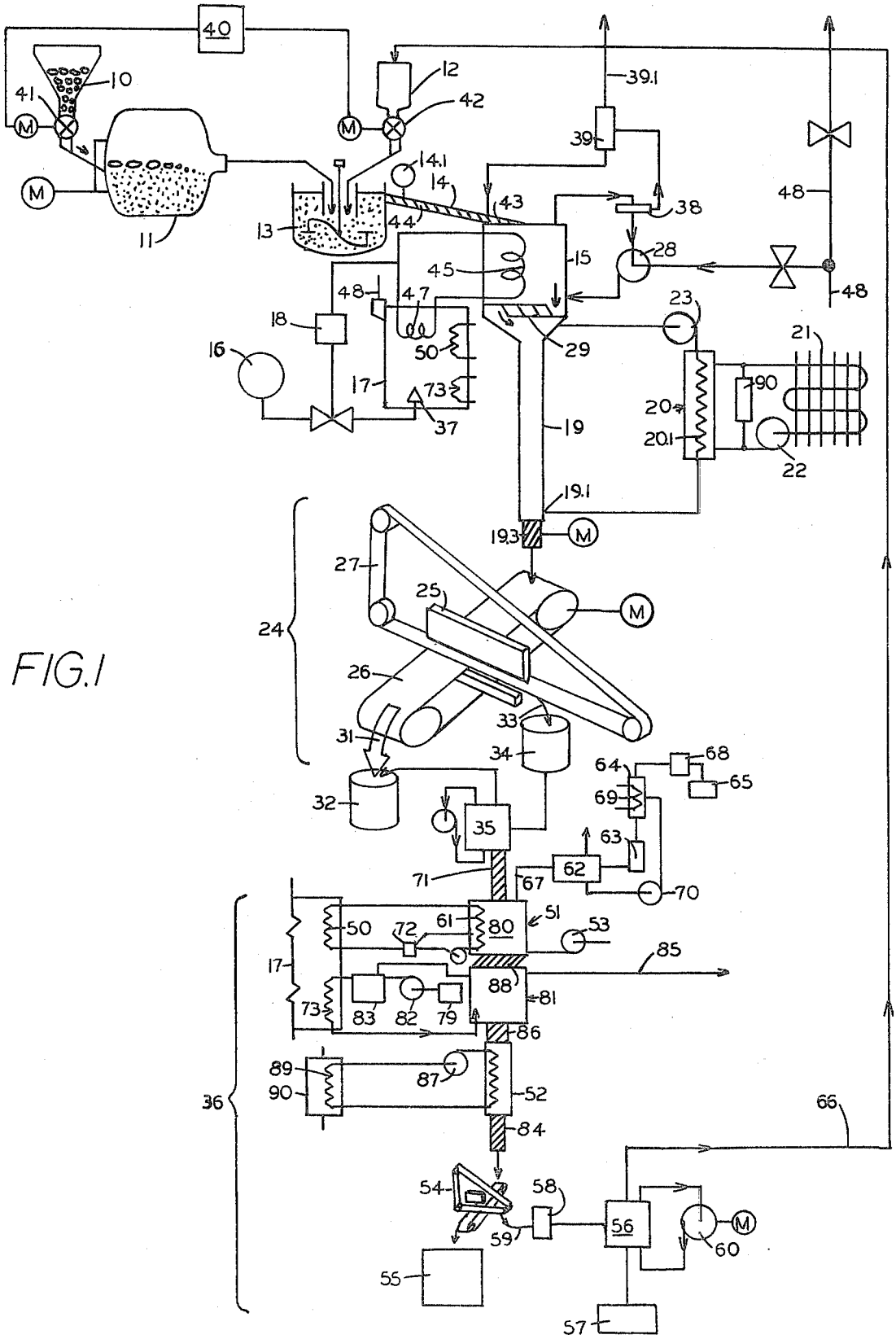
FIG. 1 is a diagrammatic representation of one process of this invention to remove sulphur from coal.

Raw sulphur bearing coal, 10, is automatically and continuously crushed and fed to a ball mill 11 for grinding to provide for reduction of such coal to particles of size of 100% minus 200 mesh, in order to thereby liberate magnetic particles and to liberate sulfur bearing particles insofar as feasible and so expose magnetic particles and sulphur bearing components to the surface of such ground coal particles. A scavenger particle dispenser 12, automatically and continuously dispenses fibrous scavenger particles — steel wool fibers of mechanically strained low carbon steel 0.1 to 0.12% C. with fiber thickness of 0.005 to 0.025 mm and width of about 0.03 to 0.10 mm and length in excess of 2 cm. — into the mixer 13, with the ground coal discharge from conventional ball mill grinder 11, in sufficient amount to carry all the sulphur to be removed from such coal on the scavenger particles on or near a minor portion of the surface of such scavenger particles. Mixer 13 operates at ambient (70°–110° F.) temperature to thoroughly mix the scavenger particles and coal particles.

The admixture of coal and scavenger is fed by a conventional screw conveyor 14 powered by a motor 14.1 and comprising a screw 44 and a tube 43 to the top of an air-tight heated chamber 15. Heater chamber 15 is a vertically extending gas-tight cylindrical tank and is provided with a heater coil 45 whereby to bring the temperature of the particulate contents of such heater tank to 350° C. A heating fuel 16, as coal, gas or oil, is passed to a burner 37 in a furnace 17 and heats a conventional heat transfer fluid in a heater coil 47, that coil being in operative connection with the heater coil 45 in heater 15.

The discharge end of tube 43 of conveyor 14 enters the top of heater 15 and so conveys the coal-scavenger mixture that there is no gas leakage upwards or gas flow downwards through conveyor 14 other than the gas carried by or entrapped in the mixture when the conveyor is moving the coal-scavenger mixture from the mixer 13 into the heater 15. A pump 28 cycles chemically inert gas, such as combination gas from chimney 48 of furnace 17 from the bottom of heater 15 to the top of heater 15 to agitate the particulate mass therein and so improve contact of separate particles of such mass with each other and with the heater coil in heater 15 and to also prevent oxidation of that particulate mass in heater 15 by exclusion of air. The temperature of the particulate mass in the heater 15 is controlled automatically by a conventional automatic controller 18. Controller 18 comprises a temperature sensitive element that senses the temperature of the heating fluid passed from the furnace 17 to the coil of heater 15 and automatically controls the rate of feed of combustible fuel 16 to the burner in the furnace 17 and the heating of the particulate mass in heater 15: the heating coils 45 provide for heat transfer from furnace 17 to the material in heater 15 without any chemical reaction between the gases in the furnace 17 and the heating fluid and without chemical reaction between the heating fluid and the materials in heater 15. A cyclone or centrifugal separator 38 separates fines carried with agitating gas from the agitating gas stream. Such fines are passed through gas-solids separator 39 and mixed in conveyor 14 with material fed to heater 15 and gas exhausted at 39.1.

In a particular preferred embodiment, the steel wool scavenger particles react in heater 15 for 90 minutes at 350° C. with the organic sulphur in the coal and cause release of such sulfur from its attachment to the coal particles and transfer of such sulfur to the surface of the steel wool scavenger particles and firmly binds such sulphur to the surface of such steel wool fibers as well as causing reduction in amount of sulfur held as pyrite (which is relatively poorly ferro magnetically susceptible) and concurrent production of more strongly ferro magnetically susceptible pyrrhotite.

While the heating of the admixture of ground crude coal and finely divided steel wool scavenger particles converts the organic sulfur in the coal to a form of sulfur adherent to the surface of those finely divided steel wool alloy particles, such heating does not consume the interior portion of such magnetic steel scavenger particles: the interior portions of the scavenger particles remain as magnetically susceptible carriers for such sulfur, and such carriers are, as below described, removed from the remainder of the treated mass of particulate coal and its impurities and recycled.

The heated and reacted mixture of particulate coal and scavenger particles is fed by an air-tight screw conveyor 29 at the bottom of heater 15 to the top of a vertical cooling chamber 19. Cooling chamber 19 is a vertically extended gas-tight cylindrical chamber that is separated from the heater 15 in substantially gas-tight manner and through which chamber (19) the reacted coal and scavenger particles pass downwardly and wherein (in chamber 19) an inert cooling gas passes upwardly through such mass of reacted particles. That cooling gas passes outwardly of cooling chamber 19 near to the top thereof to a pump 23 whereat it is passed to coils 20.1 in a secondary cooling chamber 20 and cooled therein and discharged from chamber 20 and returned in cooled condition to near the bottom of chamber 19 as at inlet 19.1. Cooling chamber 20 is, in turn, cooled by a cooling liquid which is cycled to a pump 22 through a conventional cooler 21. There is no physical admixture or reaction between the inert cooling gas passed through pump 23 and the cooling medium passed through cooler 21.

The cooled reaction mixture initially fed into top of chamber 19 is discharged from the bottom of the cooling chamber 19 at a predetermined controlled rate, as by a screw conveyor or star wheel, as 19.3, to be treated on a magnetic separator 24 such as a Whetherhill separator (as described in *Taggart Handbook of Mineral Dressing*, Section 19, page 23, Wiley & Company 1944). The feed belt 26 of the separator 24 is located directly below the discharge of the discharge element, as 19.3, of cooling chamber 19. A transverse belt 27 is driven in a path transverse to and slightly above the top of the upper surface of belt 26 and below an adjustable electromagnet 25 elongated in direction of travel of belt 27 immediately above belt 26.

The magnetic particles of steel wool with the sulphur thereon earlier absorbed from organic portions of the coal, which particles are illustrated in FIGS. 4 and 5, and any magnetic particles of pyrrhotite produced from the heating of pyrite are separated by electromagnet 25 from the coal particles on upper surface of belt 26 and travel in a path 33 parallel to the length of the transverse separator belt 27 of separator 24 to a collector tank 34 while the thereby treated or cleaned coal particles travel along belt 26 of the separator 24, along longitudinal path 31 on belt 26 to a cleaned coal product receptacle 32. The collected magnetic particles in tank 34 are cleansed in a separator 35 of coal particles and the coal particles recovered therefrom are passed to the coal product receptacle 32, while the coated magnetic scavenger particles and pyrrhotite are passed to recovery system 36. The recovery system 36 comprises a heated reaction tank chamber 51, a cooling tank 52, a magnetic separator 54 and a pneumatic separator 56 in operative combination.

The admixture of cleansed magnetically collected magnetically susceptible scavenger particles and pyrrhotite from separator 34 are fed by conventional screw conveyor 71 powered by a motor and comprising a screw and a tube to the top portion 80 of reaction chamber 51. Upper portion 80 of chamber 51 is enclosed in a vertically extending gas-tight cylindrical tank and is provided with a heater coil 61 whereby to bring the temperature of the particulate contents of such chamber to 350° C. The heating fuel 16 passed to a burner 37 in furnace 17 also heats a conventional heat transfer fluid in a heater coil, 50, that coil being in operative connection with the heater-coil 61 in chamber 51. Portions 80 and 81 are separated in gas tight manner by conveyor 84 and the material therein.

The discharge end of tube of conveyor 71 enters the top of reaction tank 51 and so conveys the scavenger-pyrrhotite mixture that there is no gas leakage upwards or gas flow downwards through conveyor 71 other than the gas carried by or entrapped in the mixture when the conveyor is moving that mixture from separator 35 into the reaction chamber 51. A pump 53 pumps gas from the bottom of heater chamber 80 to the top thereof to agitate the particulate mass therein and so improve contact of separate particles of such mass with each other and with the heater coil in chamber 80 and to also provide selective oxidation of the sulphur of the mass in chamber 80 by oxygen of the gas, which is air, with such added reactants as to achieve an oxidation-reduction potential of the gaseous mixture to substantially completely and usually selectively remove the sulphur from the scavenger particles.

The resultant sulfur dioxide-laden gases exhaust from chamber portion 80 at exhaust line 67. The temperature of the particulate mass in the lower portion 81 of the heater 51 is controlled automatically by a conventional automatic controller 83. Controller 83 comprises a temperature-sensitive element that senses the temperature of the mass in the lower portion of chamber 81 and automatically controls the temperature of reducing gas passed to the particulate mass in portion 81.

The temperature of the particulate mass in the upper portion 80 of the heater 51 is controlled automatically by a conventional automatic controller 72. Controller 72 comprises a temperature sensitive element that senses the temperature of the heating fluid passed from the furnace 17 to the coil 61 of heater 51 and automatically controls the rate of passage of heating fluid and the heating of the particulate mass in portion 80. The heating coils 61 provide for heat transfer from furnace 17 to the material in portion 80 without any chemical reaction between the gases in the furnace 17 and the heating fluid and materials in upper portion 80 of heater 51.

The reacted mixture of thus treated to be desulfurized scavenger particles is fed by an air-tight screw conveyor 88, at bottom of top portion 80 of chamber 51 to the top of the bottom portion 81 of chamber 51 and a reducing gas as hydrogen or hot carbon monoxide from tank 79 therefor is propelled by pump 82, heated by a coil 73 in furnace 17, and passed to the lower end of chamber portion 81 at a sufficiently high temperature to change any iron oxide on the scavenger particle surfaces resulting from oxidation of sulfide theretofore on such particles to iron. The resultant gas is passed to exhaust outlet 85 at upper end of chamber portion 81. The overall effect of actions in upper and lower portions of chamber 51 is to remove sulfur from the scavenger particles.

The reacted mixture of desulfurized scavenger particles is fed by an air-tight screw conveyor 86 at bottom of bottom portion 81 of chamber 51 to the top of a vertical cooling chamber 52. Cooling chamber 52 is a vertically extended gas-tight cylindrical chamber that is separated from the heater 51 in substantially gas-tight manner and through which the reacted scavenger particles pass downwardly and wherein, in chamber 52, an inert cooling gas passed upwardly through such mass of reacted particles. That cooling gas passes outwardly of cooling chamber 52 near to the top thereof to a pump 87 whereat it is passed to coil 89 in a secondary cooling chamber 90 and cooled therein and discharged from chamber 90 and returned in cooled condition to near the bottom of chamber 52. Cooling chamber 90 is, in turn, cooled by a cooling liquid which is cycled by a pump 22 through a conventional cooler 21. There is no physical admixture or reaction between the inert cooling gas passed through pump 87 and the cooling medium passed through cooler 21.

The cooled solids mixture initially fed into top of chamber 52 is discharged from the bottom of the cooling chamber 52 at a predetermined controlled rate, as by a screw conveyor 86 or star wheel, to be treated on a magnetic separator 54 like 24 — a Whetherhill separator (as described in *Taggart Handbook of Mineral Dressing*, Section 19, page 23, Wiley & Company 1944). The separator 54 comprises a first belt, like 26, a transverse belt as 27 and an adjustable electromagnet as 25 and collector tank 55 (like 32) and a magnetic product outlet 59 (like 33 and 34 in separator 24). The separator 54 is adjusted to separate the highly magnetically susceptible steel wool from the less magnetic iron oxides resulting from desulfurization of the pyrrhotite.

Figure 3:
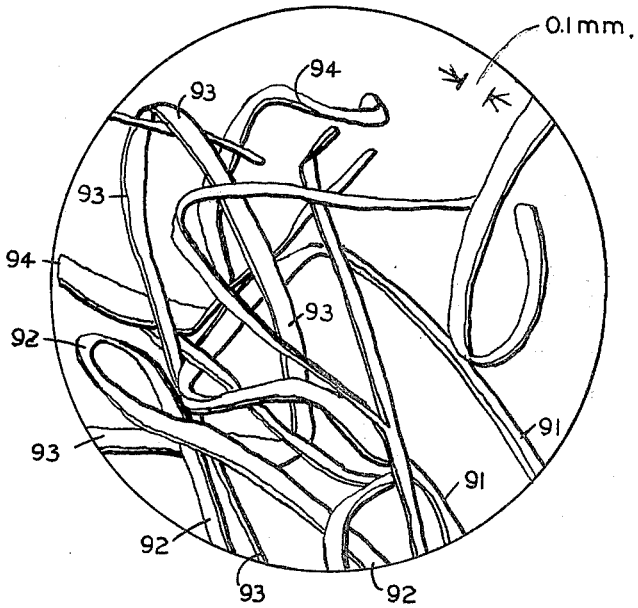
FIG. 3 is a diagrammatic view of the fresh scavenging particles used in process of FIG. 1.

As shown in FIGS. 3, 4 and 5, (items 91–94) the thin filamentary steel wool fibers of particles have a very high surface to volume ratio. Such ratio is measured by the dimensions of width and length and thickness and the overall ratio of 1,000 sq. cm. per cubic cm. The average length of the scavenger particles used is 2 to 3 cm., which is over 100 times both the other dimensions (0.1 mm and 0.025 mm) of each particle or fiber and those other dimensions are unequal. Such ratio of dimensions provides a very large amount of reactive surface of the same order of magnitude as very small particles (−20 mesh equiaxed particles). Further, the scavenger particles are also mechanically worked as they are strained during their formation (as steel wool) and so provide particularly active chemical surfaces.

However, the low bulk density of the steel wool (about 5 lb. per cubic foot) because of its convoluted shape, as illustrated in FIGS. 3, 4 and 5, provide for ready and economical separation of such magnetic material from other magnetic materials of lesser reactivity with sulfur in the coal; such ready separation permits reuse and recycling of the scavenger particles in an economic manner.

As shown in FIG. 4, the particles recovered from the reaction mass of steel wool fibers have the same tangled ribbon like structure shown for such fibers in FIG. 3 but the surface is altered from a relatively even texture to, as shown in FIG. 5, a lumpy surface rather than a smooth or a sharply angled structure to one with clearly observable, (as shown in FIG. 5,) accumulations of adherent nodules as 95–98 on each fiber as 99 in amount of about 10% and up to about 12% of the volume of the scavenger fibers. As shown in the photographs of FIG. 5, the nodules as 95–98 cover one-fourth of the surface of each fiber as 99 to a maximum height equal to the thickness of the filament in roughly pyramidal nodules.

By the above apparatus and process, at tank 51 the sulphur is burned from the coated scavenger particles and from the pyrrhotite recovered by the main magnetic separator 24 and cooled in a cooler 52 after removal of oxides from scavenger particles in lower portion 81 of chamber 51. The unchanged and the desulfurized roughly equiaxial weakly magnetic particles of pyrrhotite and the strongly magnetic fibrous scavenger particles are then separated in the secondary magnetic cleaner separator 54, as a weakly magnetic fraction, sent to collector tank 55 at discharge end of longitudinal belt of separator 54, and a highly magnetic fraction of scavenger particles discharged at the strongly magnetic product discharge 59, with such particles then sent to a pneumatic separator 56 where the characteristic of low bulk density concomitant on the convoluted shape of the filamentary or fibrous scavenger particles (as 91, 92, 93, 94, of FIG. 3) is utilized to separate the scavenger particles from any equiaxed pyrrhotite and magnetic iron oxides recovered from separator 54. The pneumatic separator 56 is fed with the mixture of magnetic materials from separator 54, (after demagnetization at a station 58): the fluffy scavenger particles are there readily separated by a stream of upwardly moving air powered by a fan 60 while the equiaxial particles are collected in a lower tank 57. The separated scavenger particles are returned to chamber 12 for reuse, as by a pneumatically powered line 66.

Experiments demonstrating critical features of the above process are as follows: The object of these experiments is to demonstrate the extraction of sulfur — principally organic sulfur — from coal by heating coal with the sulfur scavenger or acceptor 12 in a closed system. After reaction, the reaction system is quenched, the mixture of reacted coal is removed, and the sulfur scavenger or acceptor is separated — by magnetic separator. The coal is a bituminous coal designated Kentucky No. 14 having a sulfur content of 3.9% and a particle size of 100% – 200 mesh.

Experiment 1 — Five (5.0) grams of coal was blended with 0.5 grams of finely divided magnetic (ferric ferrous oxide, black). The mixture was heated (in a 3 inch by 1 inch pipe threaded at its ends and fitted with a cap at each end) at 200° C. in a Wood's Metal bath for 1 hour, quenched and the reactants removed.

The reaction mixture from Experiment 1 was slurried with demineralized water and "green soap" (6 drops) and the slurry poured through a 1 × 20 inch long tube containing 49.5g of 430 stainless steel lathe trimmings — approximately ½ × 2 inches. The tube was subjected to an external field of 20 kilogauss. Coal was eluted from the test tube with two gals. of water of wash water — with field on. The field was deenergized and the magnetic particles were eluted from the tube with 2 gallons of rinse water.

Analysis of the recovered magnetites with Hach sulfide reagent gave only a slight blue discoloration showing that only a slight reaction of the magnetite occurred with the sulfur in the coal at 200° C.

Experiment 2 — Five grams of coal was blended with 0.5 gram of iron powder, certified iron metal powder, (electrolytic I-62 from Fisher Scientific Co. Lot 732610). The mixture was heated at 200° C in a Wood's Metal bath for 1 hour, quenched and the reactants removed.

The reaction mixture from Experiment 2 was treated as in Experiment 1 except that the grey sediment was shown to be very magnetic by moving a permanent magnet below a glass vessel containing the magnetic rinse slurry. Analysis of gray particles gave a strong blue color indicating presence of sulfide on the surface of iron metal powder and showing that iron powder will abstract sulfur from coal under conditions of this experiment. These gray particles are lumpy or nodular and substantially equiaxed.

Experiment 3 — The iron containing material in Experiment 1 gave a negative reaction when tested as a control and no sulfur was captured by mechanical mixture of magnetic particles of Experiment 1 in contact with the coal.

Experiment 4 — 50 grams of 200 mesh coal was mixed with 0.5 gram ferric oxide ($Fe_3O_4$) and charged into a capped steel pipe ½ × 3 inch long. The pipe was sealed with a second cap and heated in a lead bath for 90 minutes at 350° C. After cooling, the pipe was uncapped and the contents dispersed in 500 ml. of demineralized water containing 5 drops of tincture of green soap (potassium oleate in isopropanol).

The above slurry was passed through a column containing 430 stainless steel shavings and magnetized to a field of 5–10 kilogauss. Coal was flushed from the column with demineralized water and the magnetic $Fe_3O_4$ was collected by deenergizing the magnet and rinsing out $Fe_3O_4$. Testing of the $Fe_3O_4$ with the Hach spot test for sulfide revealed a small amount of sulfide present on $Fe_3O_4$ — proving it had abstracted sulfur from coal during this autoclaving but only in small amount.

Experiment 5 — Experiment 4 was repeated except that 0.5 grams of electrolytic iron powder was used in place of 0.5 grams of $Fe_3O_4$. Analysis of the iron powder revealed by the Hach spot test presence of sulfur using Hach sulfur reagents. This experiment clearly proves that the iron powder has abstracted sulfur from coal.

Experiment 6 — Experiment 4 was repeated except that 0.5 grams steel wool (grade fine obtained from American Steel Wool Company) was mixed with coal. After reaction, the steel wool was manually removed and a portion of it tested for sulfur. A very strong sulfur reaction was obtained.

Inspection of the steel wool under microscope showed steel wool fibers to have 0.10 mm width, 0.025 mm thickness and a strained surface texture.

As shown in FIG. 3, each of the scavenger steel wool particles 91, 92, 93, 94 are flat ribbon like fibres, each very long (2–3 cm.) compared to their width (0.10 mm) and thickness (0.02 mm); hence, they have a very great amount of surface area per unit mass and have a low carbon steel preferably 0.10 to 0.12% C. and range of 0.09 to 0.15% C. Such fibrous flat and voluminous structure is utilized to provide for separation of the reacted steel wool particles from the magnetic lumpy pyrrhotite particles and pyrrhotite containing coal particles. The coal and pyrrhotite are lumpy — i.e., of no one characteristically dominant greater dimension and have generally the same ratio of surface to volume as a cube while the steel wool fibers are of distinctly different ribbon-like shape. Thereby, after the separation of magnetic particles from non-magnetic coal particles by belt 27 and air washing of coal therefrom in separator 35 and oxidizing of sulfide to oxide and change of oxide to metal in chamber 81 and cooling in chamber 52, the steel wool fibers are removed in a magnetic separator 54 (like the separator 24) from the less highly magnetized pyrrhotite particles. Therafter, the fibrous structure of the steel wool is used in an air separator 56 to separate that open ribbon-like tangled structure from the equiaxed lumpy particle of pyrrhotite.

The sulfur dioxide resulting from the burning of sulfur from the scavenger particles in upper portion 80 of tank 51 passes by line 67 to a washer tank 62 whereat a sulfur dioxide recovery agent, as diethanolomine, is used to absorb such gas; the $SO_2$-laden amine liquor is passed by pump 70 to a desorber chamber 64 wherein such liquor is heated by heater coil 69. The thereby freed sulfur dioxide is cooled and pressurized in a condenser 68 and collected in a collector tank 65; the purified amine collector is stored in a storage tank 63 for distribution to tank 62.

An automatic metering control 40 is provided to actuate the star wheels 41 and 42 which wheels respectively control the discharge of container for coal 10 and reagent 12 in such ratios as to provide for adequate amount of scavenger particles to absorb the sulphur to be removed from the coal by the above described process and so to bring the sulphur content thereof to acceptable limits; thus, 100 pounds of coal of 2% sulphur (fed to mixer 13) is reduced by 10 lbs. of steel wool (fed to mixer 13) to 1% sulphur and by 20 pounds of such steel wool to less than 0.2% sulphur by the process above described and illustrated in FIG. 1. With the scavenger particles recycled 20 times at 2% loss per cycle, as above described for process of FIG. 1 the actual amount of steel wool consumed is substantially only (± 10%) 4 lbs. steel per ton of coal per percent sulphur removed.

Heating of the gas exhausted a 39.1 may, because of fine coal dust particles therein provide an active reducing gas for use at tank 79 or a separate duct may be used to provide hot reducing gas for direct use in tank 79 from 16.

The above calculation of 80 square cm.per cm.$^3$ is based on the assumption of scavenger particle fiber width of 0.10 mm. width and thickness of 0.025 mm. Smaller fiber widths and thicknesses provide correspondingly greater surface per unit volume of scavenger particle and may be used in process of FIG. 1.

The mechanical strain applied during manufacture to the surface of the steel wool used in process of FIG. 1 and experiment 6 (grade 0 or grade fine manufactured by American Steel Wool Manufacturing Co. of Long Island City, New York 11101) is shown by that such steel wool fiber surfaces have a coarsely longitudinally grooved surface observed at 100X magnification.

While the particles of commercial wool as in household cleaning pads are frequently several inches long, the masses of steel wool (12) used in this process of FIG. 1 and Experiment 6 are used in fluffy masses of 3 to 6 lbs. per ft.$^3$ density—usually about 5 lb.per cu.ft.—and ¼ × ¼ × ¼ inches to ½ × ½ × ½ inches in size to facilitate their handling. Hence the length of fibers as 91–94 is 2 to 3 cm. in process of experiment 6 and FIG. 1.

As shown in FIG. 4 the steel wool fibers as used in process of FIG. 1 and experiment 6 are arrayed in star-shaped masses each comprising a central relatively denser tangled core 75 of convoluted fibers shaped as shon in 91–94 in FIG. 3 and a peripheral array of several radially directed elongated arms as 76, 77 and 78 each arm comprising a plurality of fibers as 189, 99 and 109.

While the above description of use of the strained steel fibers is set out in relation to coal beneficiation, the process of sulphur extraction by cyclic use of ferro magnetically susceptible ribbon-like sulphur reactive alloy fibers having mechanically strained surfaces is also applicable to removal of sulphur from other materials containing sulphur therein bound as organic sulphur (such sulphur being referred to herein as organic sulphur), such as crude petroleum and treated petroleum products. The chemical activation of the surface of the fibers due to mechanical strain and presence of different chemical components in grain boundaries than in the grains of the fibers as 189, 99, 109 provides the improvement in result illustrated by difference in sulphur extraction illustrated between experiments 6 and 5 and 4.

Figure 2:
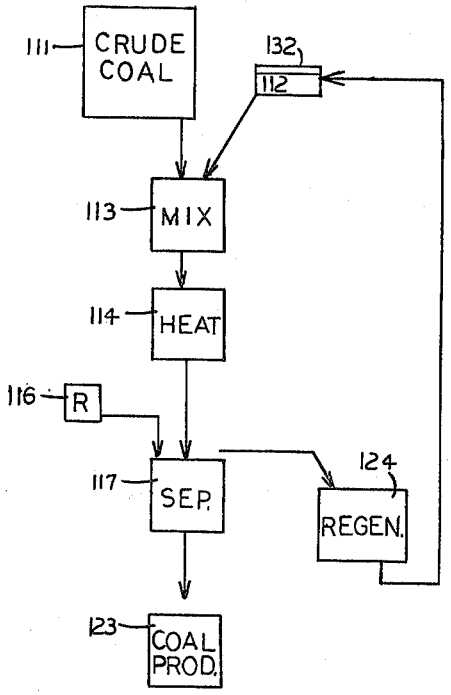
FIG. 2 is a diagrammatic representation of another process of this invention.

In another embodiment of process according to this invention as shon in FIG. 2, the scavenging metal particles 112 that are used to extract sulfur from crude ground coal 111 after admixture therewith as in a mixer 113 and heating in a gas-tight container, as 114 from which air is excluded, as in tank 15, may be particulate copper. The resultant reacted admixture of copper (with adsorbed or reacted sulfur) provided by the heated coal is and particles of coal from which sulfur was extracted are mixed with a flotation reagent R from tank 116 and treated in a flotation separator 117 to separate the copper and coal. The coal product 123 has a reduced sulfur content. The flotation fraction recovered at 124 containing the copper with adsorbed sulfide is heated in air to regenerate the copper: the regenerated copper is cycled to container 132 for reuse with another portion of coal.

Iron particles as in Experiment 5 could used in this process in place of copper and similarly recovered by flotation.

I claim:

1. Process of beneficiating crude coal including organic sulphur comprising the steps of a. grinding said crude coal to a size to produce ground coal and liberate and expose sulphur bearing components of the coal;

b. admixing with said ground coal corrosion susceptible ferromagnetic particles in finely divided particulate form and said ferromagnetic particles are composed of corrosion susceptible steel alloys;

c. heating the resulting admixture of ground coal and said ferromagnetic particles thereby converting the organic sulphur in said coal to a form a sulphur on said finely divided ferromagnetic particles, to form a second mixture comprising coal particles of reduced sulphur content and magnetically susceptible particles of increased sulphur content;

d. magnetically removing the magnetically susceptible components in the resulting second mixture from the remainder of said second mixture and collecting as a product coal of lower sulphur content than said crude coal.

2. Process as in claim 1 wherein said corrosion susceptible ferromagnetic particles each have a length and a width and a thickness with at least 1,000 square cms. of surface for each cubic centimeter of mass thereof and a particle length at least 100 times as long as the width of such particle and said steel is within range of 0.09 to 0.15% C and said particles have a mechanically strained surface.

3. Process as in claim 2 wherein said ferromagnetic particles are arrayed in masses of elongated fibers, said masses having a bulk density of 3 to 6 lbs. per cubic foot.

4. Process as in claim 3 wherein said ferromagnetic particles have a width of about 0.10 mm and thickness of about 0.025 mm.

5. Process as in claim 3 wherein said ferromagnetic particles are regenerated for further reaction with further portions of said ground coal by displacement of sulphur on said ferromagnetic particles and regeneration of a metallic surface where such sulphur had been theretofore located on said particles, followed by separation of such regenerated metallic particles by magnetic separation from magnetically susceptible particles of lesser magnetic susceptibility and separation of such regenerated metallic particles of low bulk density from particles of like magnetic susceptibility and greater bulk density.

* * * * *